US009384917B2

(12) United States Patent
Sugiyama

(10) Patent No.: US 9,384,917 B2
(45) Date of Patent: Jul. 5, 2016

(54) PUSH BUTTON SWITCH, PUSH BUTTON UNIT, AND AMUSEMENT MACHINE

(71) Applicant: OMRON Corporation, Kyoto-shi, Kyoto (JP)

(72) Inventor: Hiroaki Sugiyama, Gifu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/689,771

(22) Filed: Apr. 17, 2015

(65) Prior Publication Data

US 2015/0348723 A1 Dec. 3, 2015

(30) Foreign Application Priority Data

May 28, 2014 (JP) ..... 2014-110658

(51) Int. Cl.
*H01H 13/02* (2006.01)

(52) U.S. Cl.
CPC ..... *H01H 13/023* (2013.01); *H01H 2219/036* (2013.01); *H01H 2219/062* (2013.01)

(58) Field of Classification Search
CPC ..... H01H 13/023; H01H 2219/062; H01H 2219/036; H01H 2219/037
USPC ..... 200/314, 520, 345, 16 D, 310, 341
See application file for complete search history.

(56) References Cited

U.S. PATENT DOCUMENTS 8,558,130 B2 * 10/2013 Verd Martinez ..... H01H 9/161 200/314
2004/0118669 A1 * 6/2004 Mou ..... H01H 9/12 200/310
2005/0230233 A1 10/2005 Hoehne et al.
2009/0272640 A1 * 11/2009 Villain ..... H01H 13/503 200/520

FOREIGN PATENT DOCUMENTS

JP 2005-310772 A 11/2005
JP 2007-084206 A 4/2007

* cited by examiner

*Primary Examiner* — Edwin A. Leon
(74) *Attorney, Agent, or Firm* — Osha Liang LLP

(57) ABSTRACT

A push button switch has a button section having a push operation surface that is made of a light-transmitting material, and a light guide plate arranged in parallel with the push operation surface, a moving mechanism that causes the button section to move in parallel with a pushing direction, a detecting section that detects when the button section has moved in parallel with the pushing direction, a light source that emits light that enters the light guide plate via a lateral surface of the light guide plate, and a base positioned on a rear surface side of the button section, on which the moving mechanism is disposed. The moving mechanism holds the button section at an area other than an area corresponding to the push operation surface. The detecting section and the light source are positioned outside the area corresponding to the push operation surface.

6 Claims, 11 Drawing Sheets

PUSH BUTTON SWITCH, PUSH BUTTON UNIT, AND AMUSEMENT MACHINE

CROSS-REFERENCE TO RELATED APPLICATIONS

This Nonprovisional application claims priority under 35 U.S.C. §119 to Patent Application No. 2014-110658 filed in Japan on May 28, 2014, the entire contents of which are hereby incorporated by reference.

BACKGROUND

1. Technical Field

This disclosure relates to amusement machines and specifically to push button switches and unit used therefor.

2. Relate Art

Conventionally, there is an amusement machine called a slot machine. In the slot machine, a plurality of reels each of which displays plural symbols rotate. A payout ratio is determined depending on symbols and combinations of the symbols, which are displayed in a window when the reels stop. A player receives a prize based on the payout ratio and a wager amount. The plurality of reels start to rotate when a push button on a front surface of the slot machine has been pushed or a lever is pulled, and are then stopped by machine control.

In an amusement facility such as a casino in which slot machines are provided, amusement machines are provided that are manufactured by various manufacturers. Among such machines a player selects and plays one that suits the player's taste. Therefore, each amusement facility introduces machines that are popular with players to secure superiority over competitive amusement facilities. To meet these demands, each manufacturer strives to develop an attractive machine that can appeal to players.

Under these circumstances, a push button switch for starting rotation of reels is provided in a readily noticeable location of a slot machine front surface. Further, the push button switch is directly operated by a player. This is considered significantly important to player appeal via involving the push button switch in visual effects.

A known push button switch for starting reel rotation is configured with a face plate and a light emitting diode inside a transparent button cover so that an image or characters on the face plate inside the button can be seen by a player. However, according to this configuration, only one image or one character (string) on the face plate is shown to the player. Therefore a visual effect is provided only by switching ON/OFF the light emitting diode.

In order to solve such inconvenience, for example, Patent Literature 1 discloses a push button switch for starting rotation of reels wherein an organic light emitting diode display section is provided in a button.

Moreover, although not for an amusement machine, there is a push button switch for an elevator which switch has a configuration in which a button is made of a light guide plate so that light of a light emitting diode is emitted through the light guide plate. For example, Patent Literature 2 discloses a configuration in which front and rear surfaces of a light guide plate included in a button are subjected to different embossing processes (so as to have different light emission patterns), and a light source for a front embossed surface and a light source for a rear embossed surface are provided so as to face a lateral surface of the light guide plate at different respective heights. Patent Literature 2 discloses devices wherein the entire surface of the light guide plate is embossed, characters or numerals are depicted by embossing, and the like.

CITATION LIST

Patent Literature

[Patent Literature 1]

Japanese Patent Application Publication Tokukai No. 2005-310772 (Publication date: Nov. 4, 2005)

[Patent Literature 2]

Japanese Patent Application Publication Tokukai No. 2007-84206 (Publication date: Apr. 5, 2007)

SUMMARY

However, according to the push button switch of Patent Literature 1, the display section is provided in the button. This structure complicates an electric signal connection system such as at an interconnection part.

Moreover, according to the push button switch of Patent Literature 2, the visual effect is limited to display from the light emission pattern formed on the light guide plate. Therefore, it may be difficult to achieve complicated and exciting effects.

One or more embodiments of the present invention provides a push button switch, a push button unit, and an amusement machine having complicated and exciting effects from a simple configuration.

According to one or more embodiments of the present invention, a push button switch includes: a button section which is made of a light-transmitting material, the button section including a light guide plate arranged in parallel with a push operation surface of the button section; a moving mechanism that causes the button section to move in parallel with a pushing direction; a detecting section that detects push operation with respect to the button section when the button section has moved in parallel with the pushing direction; a light source that emits light entering the light guide plate via a lateral surface of the light guide plate; and a base located on a rear surface side of the button section and provided with at least the moving mechanism, the moving mechanism holding the button section in an area other than an area corresponding to the push operation surface, the detecting section and the light source not located in the area corresponding to the push operation surface, and wherein the base has a transparent part or an opening in the area corresponding to the push operation surface.

One or more embodiments of the present invention provides a push button switch, a push button unit, and an amusement machine that enable complicated and exciting effects with a simple configuration.

DETAILED DESCRIPTION

The following description will discuss embodiments of the present invention with reference to the attached drawings. Note, however, that the claimed invention is not limited to the below embodiments, and can be altered within scope of the present invention. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

A push button switch according to one or more embodiments of the present invention can be used in various amusement machines. In one or more embodiments of the present invention, the push button switch starts rotation of reels in a slot machine (i.e., an amusement machine).

Figure 1:
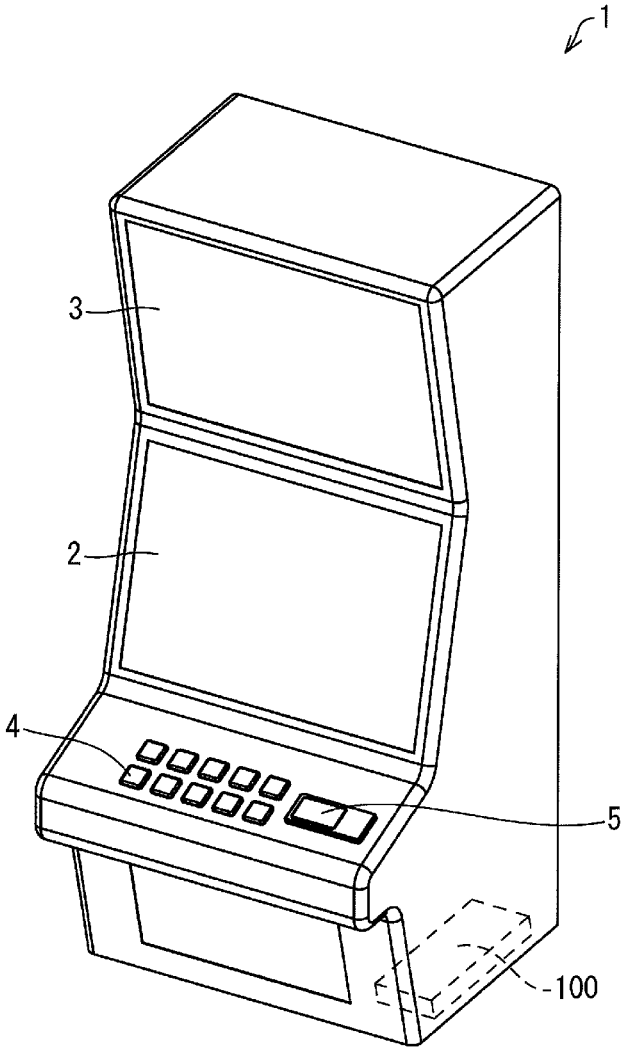
FIG. 1 is a general perspective view illustrating a slot machine that includes a push button switch, according to one or more embodiments of the present invention.

FIG. 1 is a general perspective view illustrating a slot machine 1 that includes push button switch 5 of the example. As illustrated in FIG. 1, slot machine 1 has reel section 2, which is located in a center of a front surface that faces a player (i.e., an operator).

Reel section 2 includes a plurality of reels (not illustrated) each of which displays plural kinds of symbols. The plurality of reels start to rotate when the push button switch 5 has been operated by the player, and are then automatically stopped by control of the machine. In the slot machine 1, a payout ratio is determined depending on combinations of symbols and kinds of symbols in a selected line which are displayed in a window (not illustrated) of the reel section 2 when the plurality of reels stop. The player receives a prize based on the payout ratio and bet amount. The reel section 2 can have (i) a configuration in which actual reels are provided or (ii) a configuration in which images equivalent to reels are displayed on a display screen such as a liquid crystal screen.

A display screen 3 is provided above the reel section 2 so as to display various kinds of information to the player. Moreover, a switch operation section 4 is provided below the reel section 2 in addition to the push button switch 5, which instructs start of rotation of the reels. The switch operation section 4 includes a plurality of switches that are used to select a line and to determine an amount of bet. The push button switch 5 is larger in size than each of the switches in the switch operation section 4, and has a rectangular shape extending in a horizontal direction.

Figure 2:
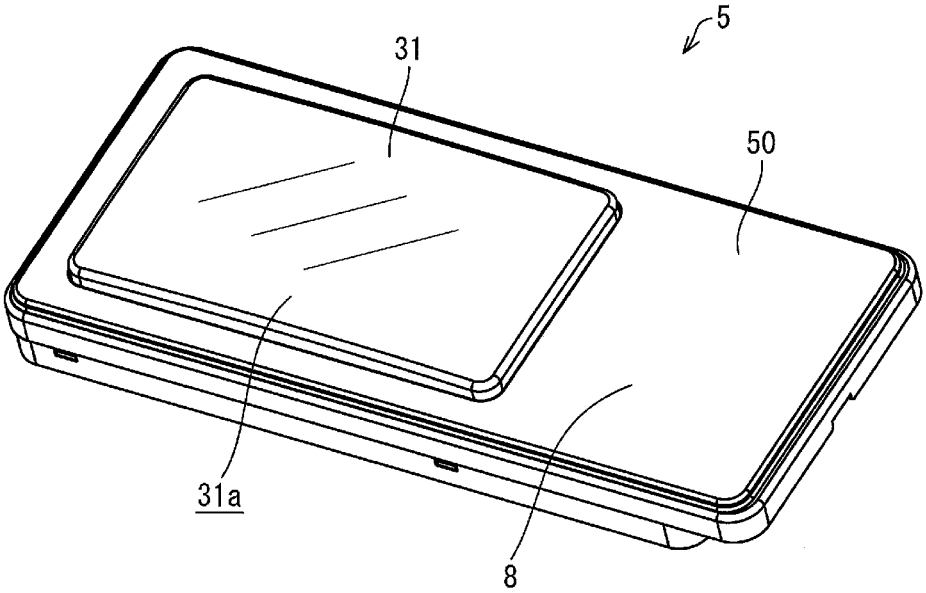
FIG. 2 is a perspective view of the push button switch.

FIG. 2 is a perspective view of the push button switch 5. As illustrated in FIG. 2, the push button switch 5 includes a rectangular button (push button) 31 to be pushed, and a top surface of the button 31 serves as a push operation surface 31*a*. The button 31 includes light guide plates 33 and 34 (see FIG. 9) inside, and is made of a transparent material so that an installation surface of the push button switch 5 can be seen via the button 31, to be exact, via the push operation surface 31*a* of the button 31. In order not to deteriorate viewability on the installation surface side via the button 31, mechanisms such as a detecting section 80 (see FIGS. 8(*a*)-8(*b*)) for detecting push operation with respect to the button 31 are collectively provided in a main body section 8 located next to the button 31 in a longitudinal direction.

Figure 3:
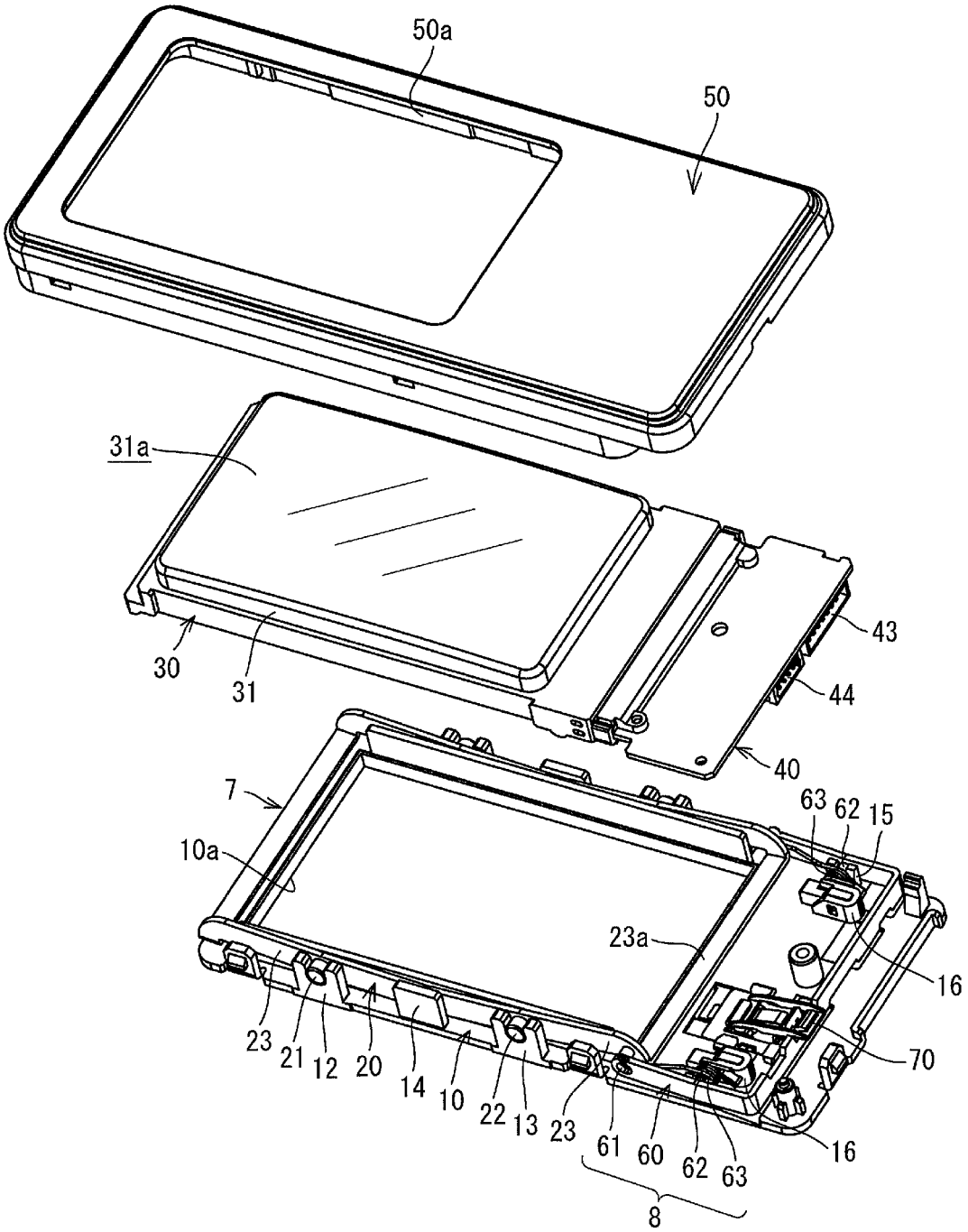
FIG. 3 is an exploded perspective view of the push button switch.

The following description provides details of the configuration of the push button switch 5. FIG. 3 is an exploded perspective view of the push button switch 5. The push button switch 5 includes a switching mechanism section 7, a button module (button section) 30, a light emission substrate 40, and an upper side case 50 (see FIG. 3). The switching mechanism section 7 includes a lower side case (base) 10 that has a bottom opening 10*a* provided in an area corresponding to the button 31, to be exact, corresponding to the push operation surface 31*a*. The switching mechanism section 7 further includes a link mechanism (moving mechanism) 20, an operation arm 60, and a ratchet mechanism 70 which are provided to the lower side case 10. The button module 30, which has the button 31, and the light emission substrate 40 are provided above the switching mechanism section 7. The upper side case 50 covers the button module 30 and the light emission substrate 40 such that the button 31 is inserted through a button opening 50*a* of the upper side case 50.

Figure 4:
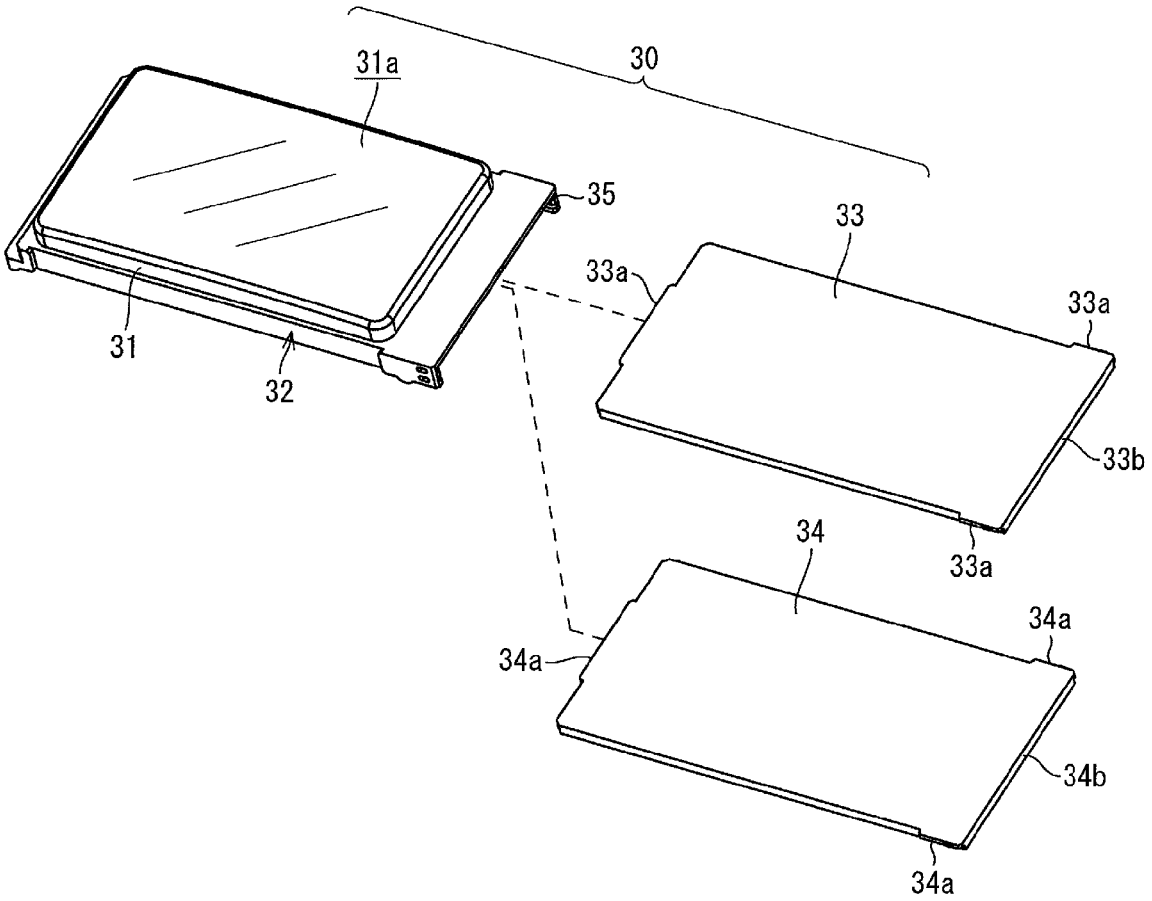
FIG. 4 is an exploded perspective view of a button module included in the push button switch.

FIG. 4 is an exploded perspective view of the button module 30. As illustrated in FIG. 4, the button module 30 includes light guide plates 33 and 34 in a button cover 32. The button cover 32 includes the button 31 which is to be inserted through the button opening 50*a* of the upper side case 50 and is made of a light-transmitting material (i.e., transparent material). The light guide plates 33 and 34 are stacked and arranged in parallel with the push operation surface 31*a* of the button 31. The light guide plates 33 and 34 are supported by a holding section 35 (provided in a peripheral part of the button 31) of the button cover 32. Specifically, a plurality of locking parts 33*a* formed at edges of the light guide plate 33 and a plurality of locking parts 34*a* formed at edges of the light guide plate 34 are caught by the holding section 35. Light enters the light guide plates 33 and 34 via respective lateral surfaces 33*b* and 34*b* which face the main body section 8 and have a length (width) greater than a side of the push operation surface 31*a* which side faces the main body section 8.

Figure 5A:
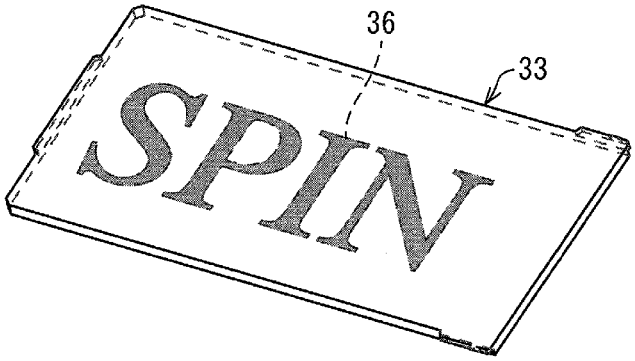
FIGS. 5(*a*)-5(*b*) are explanatory views for a light emission pattern formed on a light guide plate included in the button module.
Figure 5B:
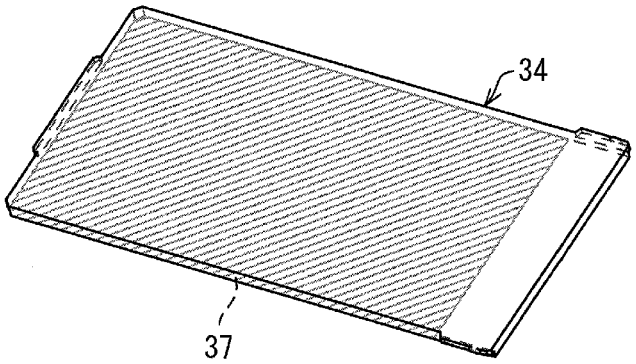

FIGS. 5(*a*)-5(*b* illustrates light emission patterns formed on the respective light guide plates 33 and 34. On each of the light guide plates 33 and 34, a light emission pattern is formed so that light, which has traveled inside, is extracted to the outside. As illustrated in FIG. 5(*a*), the light guide plate 33, which is located on an upper side in a pushing direction, has a light emission pattern 36 that is, for example, characters "SPIN". Meanwhile, as illustrated in FIG. 5(*b*), the light guide plate 34, which is located on a lower side in the pushing direction, has a light emission pattern 37 for causing light emission from an entire area corresponding to the push operation surface 31*a* of the button 31. In the example illustrated in FIGS. 5(*a*)-5(*b*), the light emission patterns are formed on respective rear surface sides of the light guide plates 33 and 34. Note, however, that the light emission patterns can be formed on respective front surface sides of the light guide plates 33 and 34.

Figure 6:
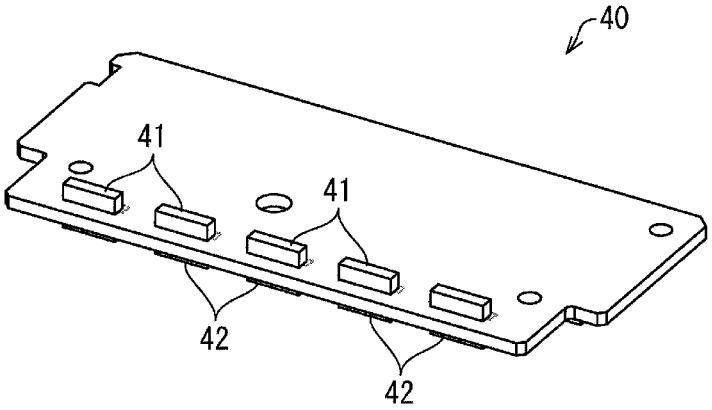
FIG. 6 is a perspective view of a light emission substrate included in the push button switch.

The light emission substrate 40 is located in the main body section 8, which is provided next to the light guide plates 33 and 34 in the longitudinal direction (see FIG. 3). FIG. 6 is a perspective view illustrating an appearance of the light emission substrate 40. As illustrated in FIG. 6, on the light emission substrate 40, a plurality of light emitting diodes (LEDs) 41 and 42 supply light to the light guide plates 33 and 34 and are arranged along a side that faces the button module 30. Among these, the plurality of LEDs 41, which are provided on a front surface (i.e., upper surface) of the light emission substrate 40 supply light to the light guide plate 33 located on the upper side. The plurality of LEDs 42, which are provided on a rear surface (i.e., lower surface) of the light emission substrate 40 supply light to the light guide plate 34 located on the lower side. The plurality of LEDs 41 do not need to emit the same color of light. The plurality of LEDs 41 may be configured to emit different colors of light to enhance the visual effect. The same applies to the plurality of LEDs 42.

Moreover, in one or more embodiments of the present invention, a moving distance of the button 31 in the pushing direction and a space between (i) the plurality of LEDs 41 and (ii) the plurality of LEDs 42 are adjusted such that light emitted from the plurality of LEDs 42, (which are provided for the light guide plate 34 on the lower side), enters the light guide plate 33 on the upper side while the button 31 is pushed. This makes it possible to continue to supply light to at least the light guide plate 33 even when a positional relation between (i) the light guide plates 33 and 34 and (ii) the plurality of LEDs 41 and LEDs 42 is changed by the pushing operation.

The light emission of the plurality of LEDs 41 and 42 is controlled by a control signal, which is externally inputted. An amount of light supplied to the light guide plates 33 and 34 is also controlled by an external input control signal. On a rear surface of the light emission substrate 40, an input side connector 43 and an output side connector 44 are provided with connected external wires (see FIG. 3). Further, the detecting section 80 (see FIGS. 8(*a*)-8(*b*)) for detecting push operation with respect to the button 31 is located on the rear surface of the light emission substrate 40. A detection result of the detecting section 80 is outputted to the outside via the external wire connected with the output side connector 44.

Figure 7:
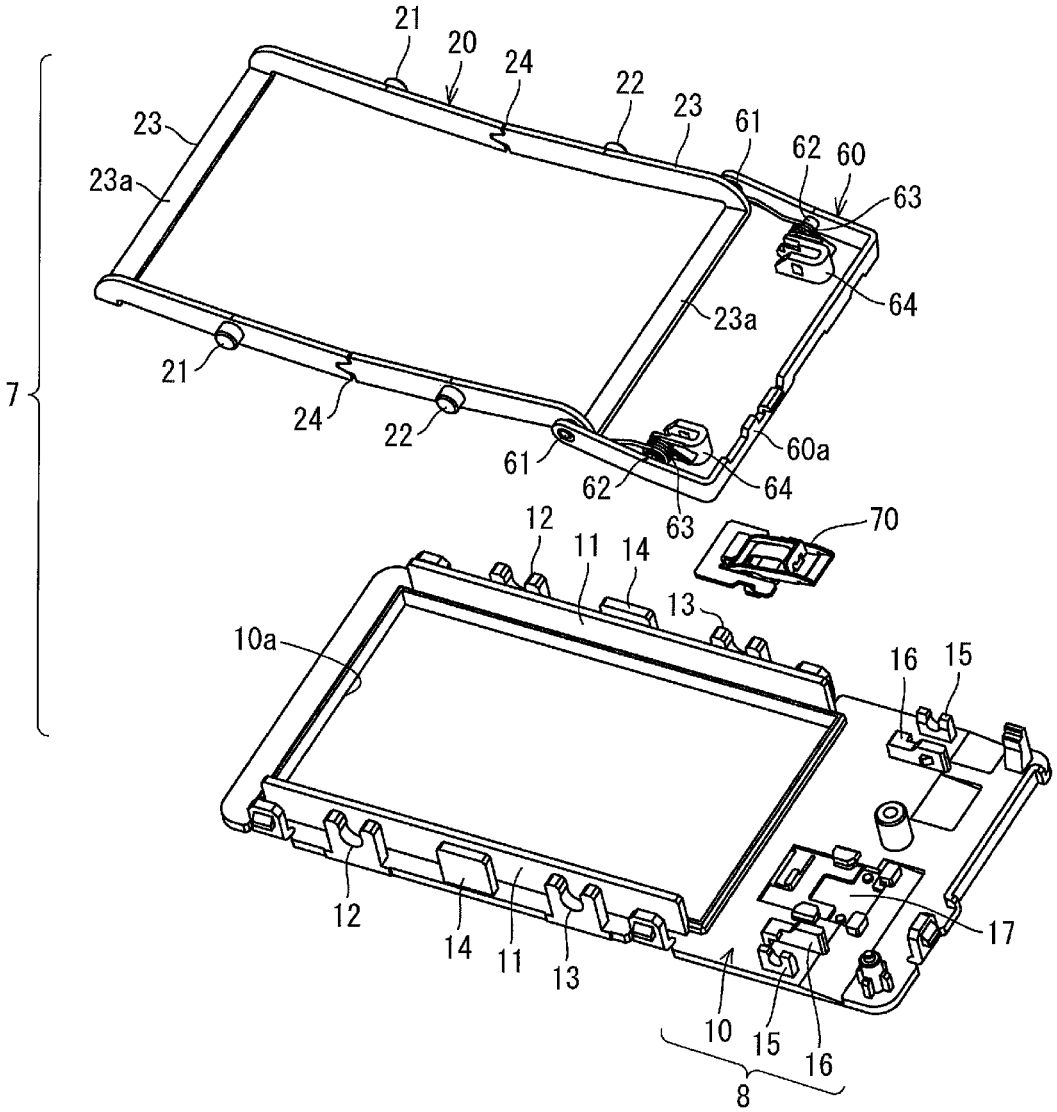
FIG. 7 is an exploded perspective view of a switching mechanism section provided in the push button switch.

FIG. 7 is an exploded perspective view of switching mechanism section 7. As illustrated in FIG. 7, the switching mechanism section 7 includes a lower side case 10, a link mechanism 20, an operation arm 60, and a ratchet mechanism 70.

The lower side case 10 constitutes a bottom surface of the push button switch 5 and, as above described, has a bottom opening 10*a* so that the installation surface on which the push button switch 5 is provided can be seen via the button 31. Although one or more of the above embodiments employs the bottom opening 10*a*, it is possible to employ (i) a configuration in which a transparent window made of a light-transmitting material is set in the bottom opening 10*a* or (ii) a configuration in which the lower side case 10 is made of a light-transmitting material and no bottom opening 10*a* is provided (i.e., having a transparent part).

The lower side case 10 has wall sections 11 that protrude upward beside the bottom opening 10*a* and extend along respective two longer sides in the longitudinal direction. Further, the lower side case 10 has (i) bearings 12 and 13 for catching respective shafts 21 and 22 of the link mechanism 20 and (ii) guides 14 for stabilizing movement of the link mechanism 20. The bearings 12 and 13 and the guides 14 are provided on outer sides of the wall sections 11.

Further, the lower side case 10 has bearings 15, setting sections 16, a setting hole 17, and the like which are provided on a part of the lower side case 10 which part is adjacent to the bottom opening 10*a* and corresponds to the main body section 8. The bearings 15 are provided for catching shafts 62 of the operation arm 60. To the setting sections 16, fixing sections 64 are attached, to each of which one end of a returning spring 63 for pushing back the pushed button 31 is fixed. To the setting hole 17, the ratchet mechanism 70 is inserted.

The link mechanism 20 allows the button module 30 to move in parallel with the pushing direction. The link mechanism 20 has a rectangular frame structure which is made up of two lever links 23 (i) each of which has an angular U-shape and (ii) which are coupled in a bendable manner. The link mechanism 20 has longer sides each of which has a connection part 24 and shafts 21 and 22. The link mechanism 20 is provided so as to surround the bottom opening 10*a* and so that (i) each of the longer sides is located between the wall section 11 and the guide 14 of the lower side case 10 and (ii) the shafts 21 and 22 are supported by the bearings 12 and 13. The two lever links 23 of the link mechanism 20 are configure to move in an up-and-down direction in conjunction with each other and to move symmetrically with respect to the connection parts 24.

The rear surface of the button module 30 is held by supporting sections 23*a*, which are shorter sides of the link mechanism 20 (i.e., each of which is part of the lever link 23). The button 31 of the button module 30 is located inside (i) the frame of the link mechanism 20 and (ii) the bottom opening 10*a*, while being held by the link mechanism 20.

The operation arm 60 swings such that the detecting section 80 can detect push operation with respect to the button 31. The operation arm 60 has an angular U-shape. An open side of the angular U-shape of the operation arm 60 is attached to an end part (opposite to the connection part 24) of the lever link 23, which is located on the main body section 8 side, in a swingable manner by the shafts 61. Further, the operation arm 60 is also swingably supported by the shafts 62 on an inner side of the angular U-shape. When the lever link 23 is moved such that the connection parts 24 move upward and the end part on which the shafts 61 are provided moves downward, the operation arm 60 rotates around the shafts 62 so that a part 60*a* of the operation arm 60 (on a closed side of the angular U-shape) moves upward. Meanwhile, when the lever link 23 is moved such that the connection parts 24 move downward and the end part on which the shafts 61 are provided moves upward, the operation arm 60 rotates around the shafts 62 so that the part 60*a* moves downward.

Figure 8A:
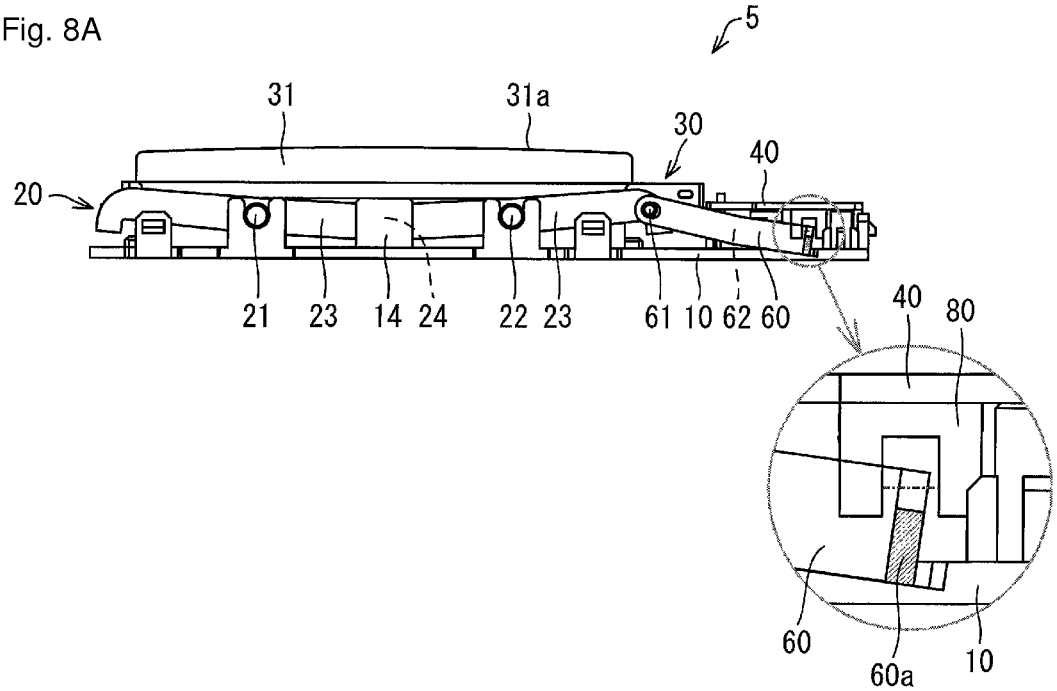
FIGS. 8(*a*)-8(*b*) are explanatory views of operation of the push button switch.
Figure 8B:
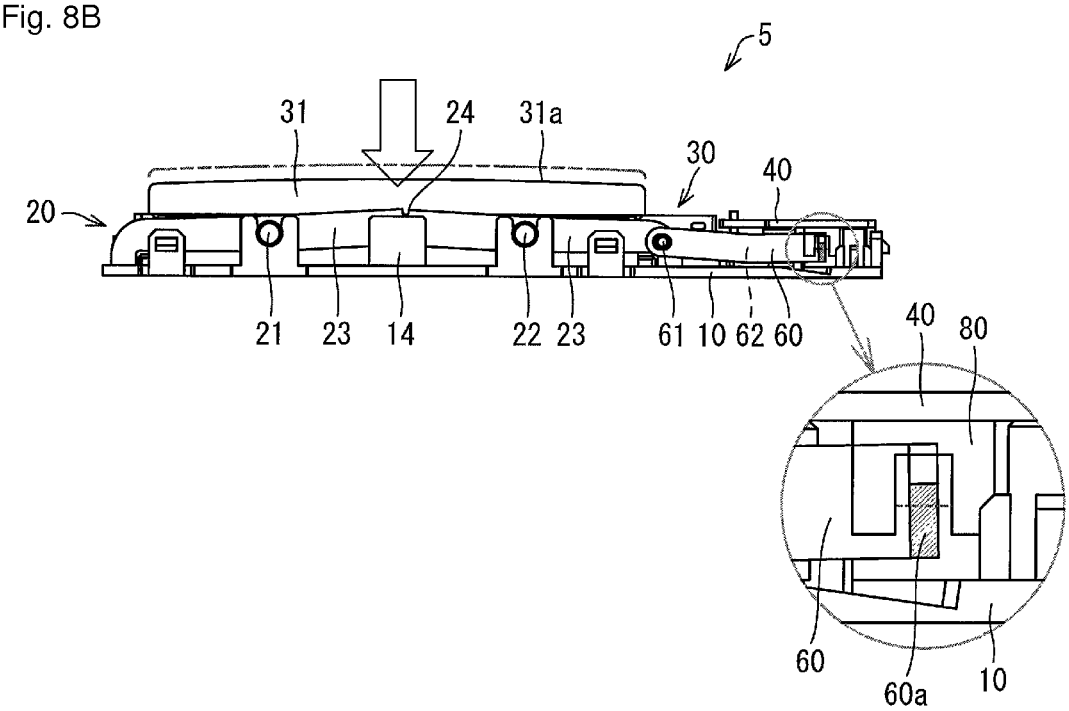

The detecting section 80 (see FIGS. 8(*a*)-8(*b*)) is configured by a photomicrosensor and detects pushing operation with respect to the button 31 when the photomicrosensor has been prevented from receiving light by the part 60*a* of the operation arm 60.

Further, the operation arm 60 is provided with the returning springs 63 (i) in each of which the shaft 62 is inserted and (ii) which push back the pushed button 31. One end of the returning spring 63 is attached to the fixing section 64 and the other end is attached to the shaft 61 so as to apply upward force to the shaft 61.

The ratchet mechanism 70 is set to the setting hole 17 provided in the lower side case 10. The ratchet mechanism 70 engages with the part 60*a* of the operation arm 60 and provides operational feeling (i.e., tactile feedback) in conjunction with push operation with respect to the button 31.

FIGS. 8(*a*)-8(*b*) are explanatory views for explaining operation on the push button switch 5. As illustrated in FIG. 8(*a*), while the button 31 is not pushed, the shafts 61 are lifted upward by the force applied by the returning springs 63 (see FIGS. 3 and 7). When the shafts 61 are thus lifted upward, the link mechanism 20 is bent such that the supporting sections

23*a* go upward and the connection parts 24 go downward, and the part 60*a* of the operation arm 60 goes downward and does not prevent the detecting section 80 (which is the photomicrosensor) from receiving light.

While the button 31 is being pushed, the shafts 61 are moved downward against the force applied by the returning springs 63 (see FIG. 8(*b*)). In conjunction with this, the link mechanism 20 is bent such that the supporting sections 23*a* are moved downward and the connection parts 24 are moved upward, and accordingly the part 60*a* of the operation arm 60 is moved upward. When the part 60*a* is thus moved upward, the detecting section 80 (which is the photomicrosensor) is prevented from receiving light, and therefore the detecting section 80 detects that the button 31 is being pushed.

When the pushing with respect to the button 31 has been cancelled, the shafts 61 are lifted upward by the force applied by the returning springs 63 (see FIGS. 3 and 7) and return to a state illustrated in FIG. 8(*a*).

The lever links 23 of the link mechanism 20 move symmetrically with respect to the connection parts 24, and therefore the button module 30 is moved in parallel with the pushing direction even when a part other than a center part of the button 31 has been pushed.

As above described, the push button switch 5 has the configuration in which (i) the button 31 includes the light guide plates 33 and 34 inside thereof and is made of a transparent material so that an installation surface on which the push button switch 5 is provided can be seen through the button 31 and (ii) the mechanisms such as the detecting section 80 for detecting push operation with respect to the button 31 are collectively provided in the main body section 8 located next to the button 31 in the longitudinal direction so that viewability on the installation surface side via the button 31 will not be deteriorated.

This makes it possible to bring about complicated and exciting effects with the use of (i) display by the light emission patterns formed on the light guide plates 33 and 34 of the button module 30 and (ii) display on the installation surface on which the push button switch 5 is provided.

The push button switch 5 can be, for example, provided on a display surface of a liquid crystal display device. This makes it possible to render visual effects with the use of (i) display on the display surface of the liquid crystal display device and (ii) display by the light emission patterns 36 and 37 of the light guide plates 33 and 34.

Alternatively, the push button switch 5 can be provided on a plate (face plate, design panel) on which an image or characters are displayed. This makes it possible to render visual effects with the use of (i) display of the image or the characters on the plate and (ii) display by the light emission patterns 36 and 37 of the light guide plates 33 and 34.

Figure 9:
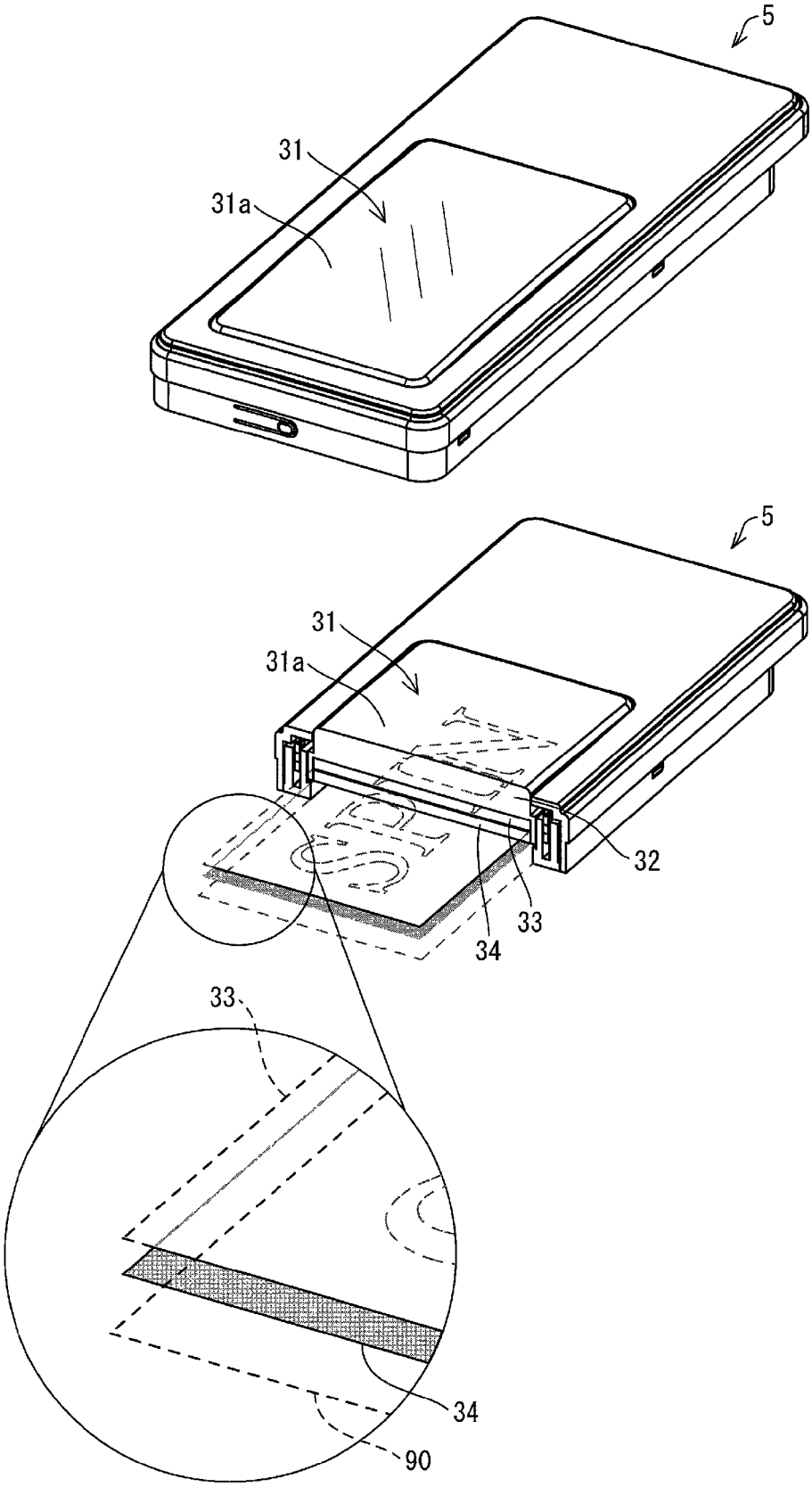
FIG. 9 is an explanatory view of a positional relation of height between the light guide plate and a display surface of a liquid crystal display device according to one or more embodiments of the present invention, wherein the push button switch is on the display surface.

FIG. 9 is an explanatory view of a positional relation of height between the light guide plates 33 and 34 and a display surface 90 of a liquid crystal display device in a case where the push button switch 5 is provided on the display surface 90. As illustrated in FIG. 9, a display surface of the light guide plate 33 and a display surface of the light guide plate 34 are physically separate from the display surface 90 of the liquid crystal display device in a height direction, and also the display surface of the light guide plate 33 and the display surface of the light guide plate 34 are separate from each other in the height direction. This makes it possible to provide a visual effect with a sense of depth by the displays.

Figure 10A:
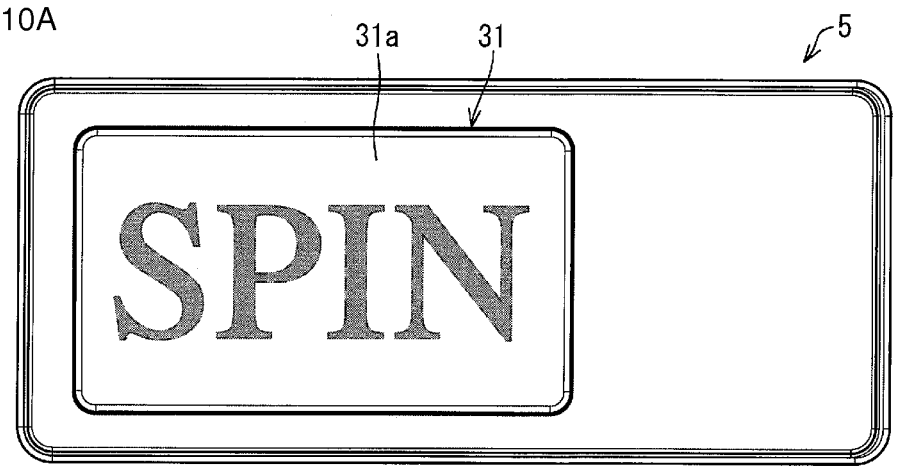
FIGS. 10(*a*)-10(*c*) are explanatory views of an exemplary display carried out by light emitted through the light guide plate of the push button switch.
Figure 10B:
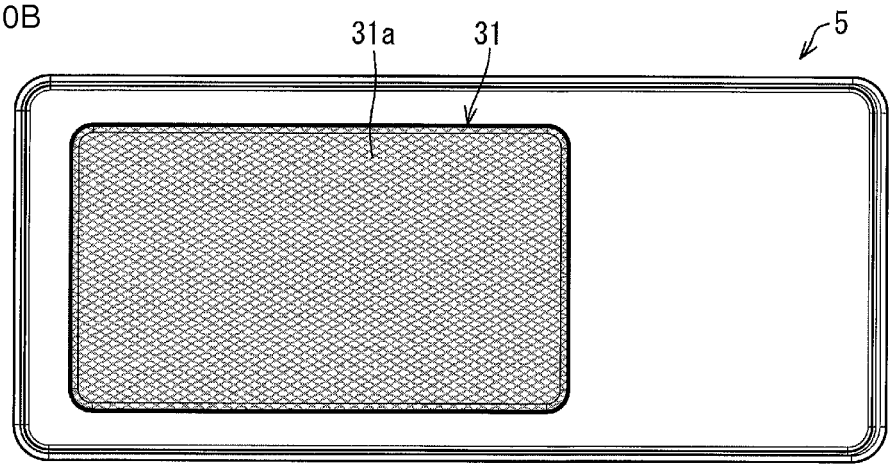
Figure 10C:
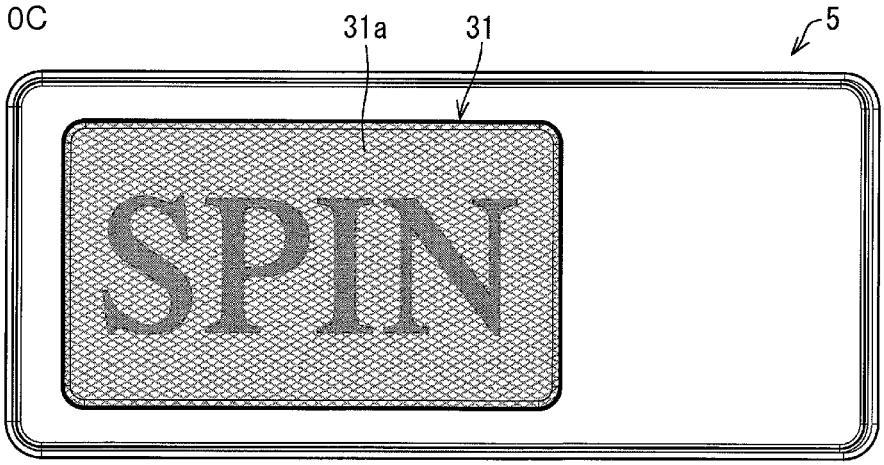

FIGS. 10(*a*)-10(*c*) are explanatory views of an example of display carried out by light emitted through the light guide plates 33 and 34 of the push button switch 5. Item FIG. 10(*a*) illustrates a display example in which only the light guide plate 33 on the upper side is lit up. Characters "SPIN" are displayed in and above an installation surface (i.e., the display surface 90 of the liquid crystal display device or the surface of the plate on which an image or characters are displayed) on which the push button switch 5 is provided, so that the player feels as if the characters "SPIN" are floating. Item FIG. 10(*b*) illustrates a display example in which only the light guide plate 34 on the lower side is lit up. Light is emitted from an entire surface located in and above the installation surface on which the push button switch 5 is provided, and it is therefore possible to prevent the display on the installation surface from being seen (i.e., to hide the display) from the player by heightening luminance by increasing an amount of light supplied from the plurality of LEDs 42. Item FIG. 10(*c*) illustrates a display example in which both the light guide plates 33 and 34 are lit up. The characters "SPIN" are displayed in and above the light emission surface, so that the player feels as if the characters "SPIN" are floating in the light emitted from the entire surface.

Figure 11A:
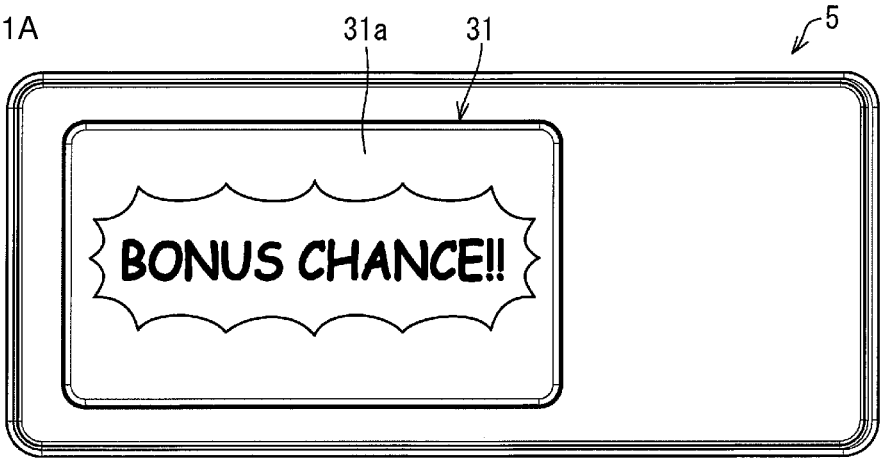
FIGS. 11(*a*)-11(*c*) are explanatory views of a display on an installation surface seen by light emitted through the light guide plate of the push button switch.
Figure 11B:
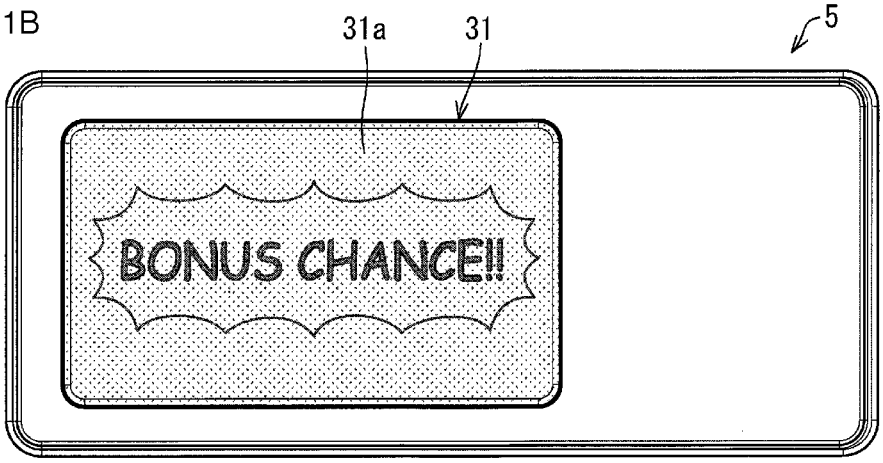
Figure 11C:
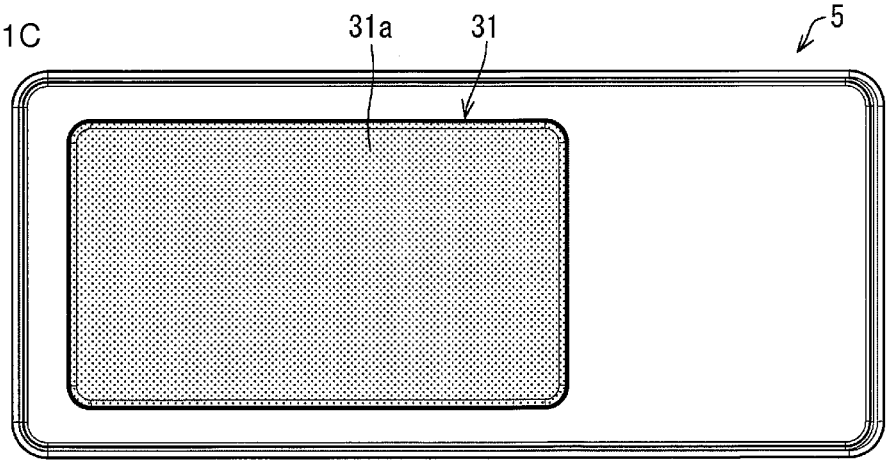

FIGS. 11(*a*)-11(*c*) are explanatory views of how a display on an installation surface is seen by light emitted through the light guide plate 34 of the push button switch 5. Item FIG. 11(*a*) illustrates an example of a state in which both the light guide plates 33 and 34 are not lit up. In this state, the player can clearly see characters "BONUS CHANCE" displayed on the installation surface on which the push button switch 5 is provided. Item FIG. 11(*b*) is a display example in which only the light guide plate 34 on the lower side is lit up with a medium degree of luminance. Light is emitted from the entire surface located in and above the installation surface, and therefore it becomes difficult for the player to see the characters "BONUS CHANCE" displayed on the installation surface. Item FIG. 11(*c*) illustrates a state in which the luminance of the light guide plate 34 is further heightened by increasing the amount of light supplied from the plurality of LEDs 42. In this case, the player cannot see the characters "BONUS CHANCE" displayed on the installation surface.

In a case where the display states illustrated in FIG. 11(*a*)-11(*c*) are carried out in an order of, for example, 11(*c*), 11(*b*), 11(*c*), 11(*b*), . . . and 11(*a*), a feeling of expectancy for a bonus chance indicated by the characters "BONUS CHANCE" is heightened, and it is thus possible to render an exciting visual effect. In a case where the installation surface is the display surface 90 of the liquid crystal display device, contents to be displayed on the installation surface can be changed variously, and it is therefore possible to render further complicated and exciting visual effects.

As such, by installing the push button switch 5 of one or more embodiments of the present invention, the slot machine 1 of one or more embodiments of the present invention can render (i) a shining visual effect in which light is emitted from the entire surface of the button 31 and (ii) a visual effect in which an image or characters displayed on the installation surface are switched between visible and invisible through the button 31. From these effects, it is possible to provide new excitement to players. Further, it is possible to render a three-dimensional visual effect to players by displaying an image or characters in and above the installation surface.

The visual effect rendered by the use of the light guide plates 33 and 34 and the visual effect involving variable display of the display surface 90 in the slot machine 1 are executed by the control section 100 provided in the slot machine 1 (see FIG. 1). The control section 100 includes a CPU and a storage section and controls the constituent members in the slot machine 1 such as the reel section 2, the display screen 3, the switch operation section 4, and the push button switch 5. In the storage section, various visual effect contents are stored. The CPU reads out a visual effect content from the storage section, and drives the constituent members of the slot machine 1 in accordance with the visual effect content so as to execute the visual effect. Note that it is possible to employ a configuration in which the push button switch 5 includes a control circuit that only carries out control in relation to the push button switch 5.

According to one or more embodiments of the present invention, the liquid crystal display device or the plate (on which an image or characters are displayed), on which the push button switch 5 is provided, is configured separately from the push button switch 5. Note, however, that the liquid crystal display device or the plate can be integrated with the push button switch 5 so as to provide a push button unit.

According to one or more embodiments of the present invention, the number of light guide plates, which are provided in the button module 30, is 2. Note, however, that the number of light guide plates can be 3 or more or can be 1. The visual effect of the display example illustrated in FIGS. 11(*a*)-11(*c*) can be sufficiently rendered by a configuration that includes only the light guide plate 34 that (i) is on the lower side and (ii) has the light emission pattern 37 of entire surface emission. Alternatively, it is possible to use light emission patterns whose number is larger than that of a light guide plate(s) by forming light emission patterns on both sides (i.e., front and rear surfaces) of a light guide plate or by stacking, with gaps, a plurality of light guide plates each of which has light emission patterns formed on its both sides (i.e., front and rear surfaces).

According to one or more embodiments of the present invention, the main body section 8 is provided next to the button 31 in the longitudinal direction. Note, however, that the main body section 8 can be provided next to the button 31 in any direction. The shape of the button 31 is not limited to the rectangular shape and can be a circular shape, an elliptical shape, or the like. Note, however, that, in a case where the button 31 is used in combination with a display device such as a liquid crystal display device, according to one or more embodiments of the present invention, the button 31 has a rectangular shape that is similar to a shape of the display device.

According to one or more embodiments of the present invention, the plurality of LEDs 41 and 42 do not move together with the light guide plates 33 and 34. Note, however, that it is possible to employ a configuration in which the plurality of LEDs 41 and 42 move together with the light guide plates 33 and 34.

As above described, a push button switch according to one or more embodiments of the present invention may include: a button section made of a light-transmitting material, the button section including a light guide plate arranged in parallel with a push operation surface of the button section; a moving mechanism that causes the button section to move in parallel with a pushing direction; a detecting section that detects push operation with respect to the button section when the button section has moved in parallel with the pushing direction; a light source that emits light that enters the light guide plate via a lateral surface of the light guide plate; and a base located on a rear surface side of the button section and which has at least the moving mechanism. The moving mechanism holds the button section in an area other than an area corresponding to the push operation surface, the detecting section and the light source are located in an area other than the area corresponding to the push operation surface, and the base has a transparent part or an opening in the area corresponding to the push operation surface.

This makes it possible to render complicated and exciting effects with the use of (i) display of a light emission pattern formed on the light guide plate provided in the button section and (ii) display on an installation surface on which the push button switch is provided. The push button switch can be provided on, for example, a display surface of a liquid crystal display device. In such a case, it is possible to render a visual effect with the use of (i) display on the display surface of the liquid crystal display device and (ii) display of the light emission pattern of the light guide plate. Alternatively, the push button switch can be provided on a plate (face plate, design panel) on which an image or characters are displayed. In such a case, it is possible to render a visual effect with the use of (i) display of the design or the characters on the plate and (ii) display of the light emission pattern of the light guide plate.

The push button switch according to one or more embodiments of the present invention includes a plurality of stacked light guide plates; and the light source is located so as to supply light to each of the plurality of light guide plates.

By thus employing the plurality of light guide plates, it is possible to use a larger number of light emission patterns. This allows further complicated and attractive effects.

According to a push button switch according to one or more embodiments of the present invention, the push button switch can include a plurality of light sources each of which can be an independent light source; the plurality of light sources are provided so as not to move together with the button section; and the plurality of light sources are provided such that light from one of the plurality of light sources provided for a lower one of the plurality of light guide plates, enters an upper one of the plurality of light guide plates while the button section is being pushed, the upper one of the plurality of light guide plates being located on an upper side in the pushing direction, and the lower one of the plurality of light guide plates being located on a lower side in the pushing direction.

From this, even when the positional relation between (i) the plurality of light guide plates and (ii) the plurality of light sources in the button section is changed by the pushing operation, it is possible to continue to supply light to at least one of the plurality of light guide plates.

The push button unit according to one or more embodiments of the present invention includes the push button switch according to one or more embodiments of the present invention and a display device provided on a rear surface side of the push button switch.

The amusement machine according to one or more embodiments of the present invention includes the push button switch according to one or more embodiments of the present invention and a control section, which controls light emission of the light source.

The scope of the invention also includes (i) the push button unit including the push button switch according to one or more embodiments of the present invention, and (ii) the amusement machine including the push button switch.

According to the amusement machine of one or more embodiments of the present invention, it is possible that the light guide plate has a light emission pattern for emitting light from the entire area corresponding to the push operation surface; and the control section variably controls an amount of light, which is supplied from the light source to the light guide plate having the light emission pattern, so as to adjust viewability, through the push operation surface, of an installation surface on which the push button switch is provided.

This allows an exciting visual effect, which heightens a feeling of expectancy by causing display on the installation side to appear and disappear.

The described embodiments are not limited to the examples described herein, but can be altered by a skilled person in the art within the scope of the claims. That is, an embodiment derived from a proper combination of technical means appropriately modified within the scope of the claims is also encompassed in the technical scope of the claimed invention.

One or more embodiments of the present invention may be employed in amusement machines such as a slot machine, a poker game machine, a mah-jong game machine, and a playing card game machine.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A push button switch comprising:

a button section comprising:

a push operation surface that is made of a light-transmitting material, and a light guide plate arranged in parallel with the push operation surface;

a moving mechanism that causes the button section to move in parallel with a pushing direction;

a detecting section that detects when the button section has moved in parallel with the pushing direction;

a light source that emits light that enters the light guide plate via a lateral surface of the light guide plate; and a base positioned on a rear surface side of the button section, on which the moving mechanism is disposed, wherein the moving mechanism holds the button section at an area other than an area corresponding to the push operation surface, wherein the detecting section and the light source are positioned outside the area corresponding to the push operation surface, and wherein the base has a transparent part or an opening in the area corresponding to the push operation surface.

2. The push button switch as set forth in claim 1, wherein the push button switch includes stacked light guide plates, each of which provides light independently, and wherein the light source is positioned to supply light to each light guide plate.

3. The push button switch as set forth in claim 2, wherein the push button switch comprises a plurality of light sources, wherein each light source is positioned not to move with movement of the button section, and wherein the plurality of light sources are arranged such that light from one light source positioned to provide light for a lower one of the plurality of light guide plates, enters an upper one of the plurality of light guide plates while the button section is pushed, wherein the upper one of the plurality of light guide plates is positioned on an upper side in the pushing direction, and the lower one of the plurality of light guide plates is positioned on a lower side in the pushing direction.

4. A push button unit comprising:

a push button switch as recited in claim 1; and a display device provided on a rear surface side of the push button switch.

5. An amusement machine comprising:

a push button switch as recited in claim 1; and a control section that controls light emission of the light source.

6. The amusement machine as set forth in claim 5, wherein the light guide plate has a light emission pattern for emitting light from the entire area corresponding to the push operation surface, and wherein the control section controls light intensity supplied from the light source to the light guide plate having the light emission pattern, so as to adjust viewability, through the push operation surface, of an installation surface on which the push button switch is provided.

* * * * *